US006113524A

United States Patent [19]

Huang

[11] Patent Number: 6,113,524

[45] Date of Patent: Sep. 5, 2000

[54] BRIDGE FLEX MACHINE

[76] Inventor: Chao-Chiang Huang, P.O. Box 82-144, Taipei, Taiwan

[21] Appl. No.: 09/411,858

[22] Filed: Oct. 4, 1999

[51] Int. Cl.[7] ..... A63B 21/00

[52] U.S. Cl. ..... 482/142; 482/95; 482/96

[58] Field of Search ..... 482/142, 95, 96, 482/130, 137, 135, 132–136, 145

[56] References Cited

U.S. PATENT DOCUMENTS

| | | | |
|---|---|---|---|
| 2,470,544 | 5/1949 | Bell | 482/95 |
| 5,342,269 | 8/1994 | Huang et al. | 482/95 |
| 5,580,340 | 12/1996 | Vu | 482/96 |
| 5,658,227 | 8/1997 | Stearns | 482/96 |
| 5,669,865 | 9/1997 | Gordon | 482/142 |

*Primary Examiner*—Jerome Donnelly

*Attorney, Agent, or Firm*—A & J

[57] ABSTRACT

A bridge flex machine includes a base composed of a first rod, a second rod and two transverse rods mounted between the first and second rods, a triangular block mounted on the base and located to the first rod, a U-shaped member slantingly inserted into the triangular member and fixedly mounted thereon by a bolt, an oscillating rod pivotally connected with upper ends of the U-shaped member, a rectangular frame arranged on the oscillating rod, a vertical rod with a U-shaped cross section vertically mounted on an intermediate portion of the base, a T-shaped rod vertically inserted in the vertical rod, a U-shaped rod mounted on the base, a rectangular rack pivotally mounted on two ends of the U-shaped rod, and a foldable rod having an end pivotally connected to a bottom of the rectangular rack and another end pivotally connected to an end of the oscillating rod, whereby one may use the machine to release pains and aches in the back and waist.

3 Claims, 6 Drawing Sheets

BRIDGE FLEX MACHINE

BACKGROUND OF THE INVENTION

1. Field of the Invention

This invention is related to a bridge flex machine and in particular to one which can relieve pains and aches in the back and waist.

2. Description of the Prior Art

A number of exercise devices have been designed and developed to enable people to take exercise indoors. Examples of the most popular exercise devices are treadmills for simulating walking and jogging, stationary bicycles for simulating riding bicycles, and rowing exercisers for simulating rowing boats. However, none of them are designed for stretching one's muscles on the back thereby rendering them unable to relieve pains and aches in the back and waist.

Therefore, it is an object of the present invention to provide a bridge flex machine which can relieve pains and aches in the back and waist.

SUMMARY OF THE INVENTION

This invention is related to a bridge flex machine.

According to a preferred embodiment of the present invention, a bridge flex machine includes a base composed of a first rod, a second rod and two transverse rods mounted between the first and second rods, a triangular block mounted on the base and located to the first rod, a U-shaped member slantingly inserted into the triangular member and fixedly mounted thereon by a bolt, an oscillating rod pivotally connected with upper ends of the U-shaped member, a rectangular frame arranged on the oscillating rod, a vertical rod with a U-shaped cross section vertically mounted on an intermediate portion of the base, a T-shaped rod vertically inserted in the vertical rod, a U-shaped rod mounted on the base, a rectangular rack pivotally mounted on two ends of the U-shaped rod, and a foldable rod having an end pivotally connected to a bottom of the rectangular rack and another end pivotally connected to an end of the oscillating rod.

It is the primary object of the present invention to provide a bridge flex machine which can relieve pains and aches in the back and waist.

It is another object of the present invention to provide a bridge flex machine which can be folded thus making it easier to stow when not in use.

It is still another object of the present invention to provide a bridge flex machine which is compact in size and simple in construction.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
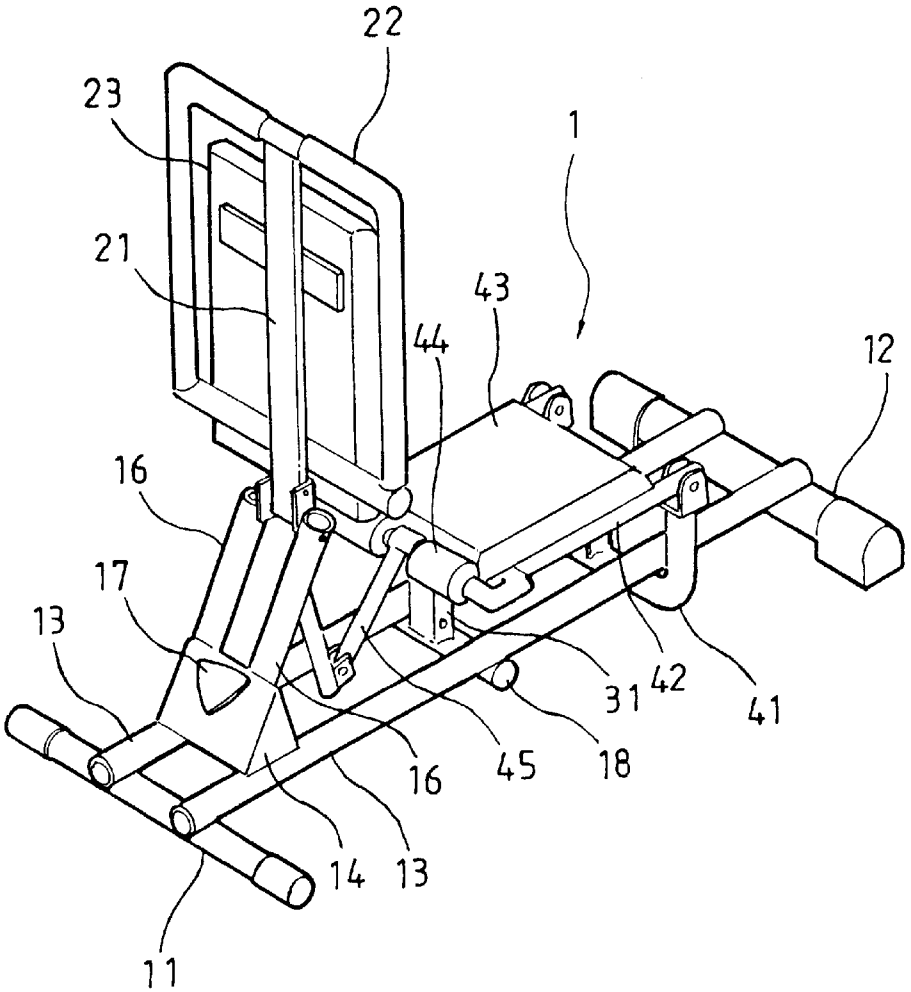
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
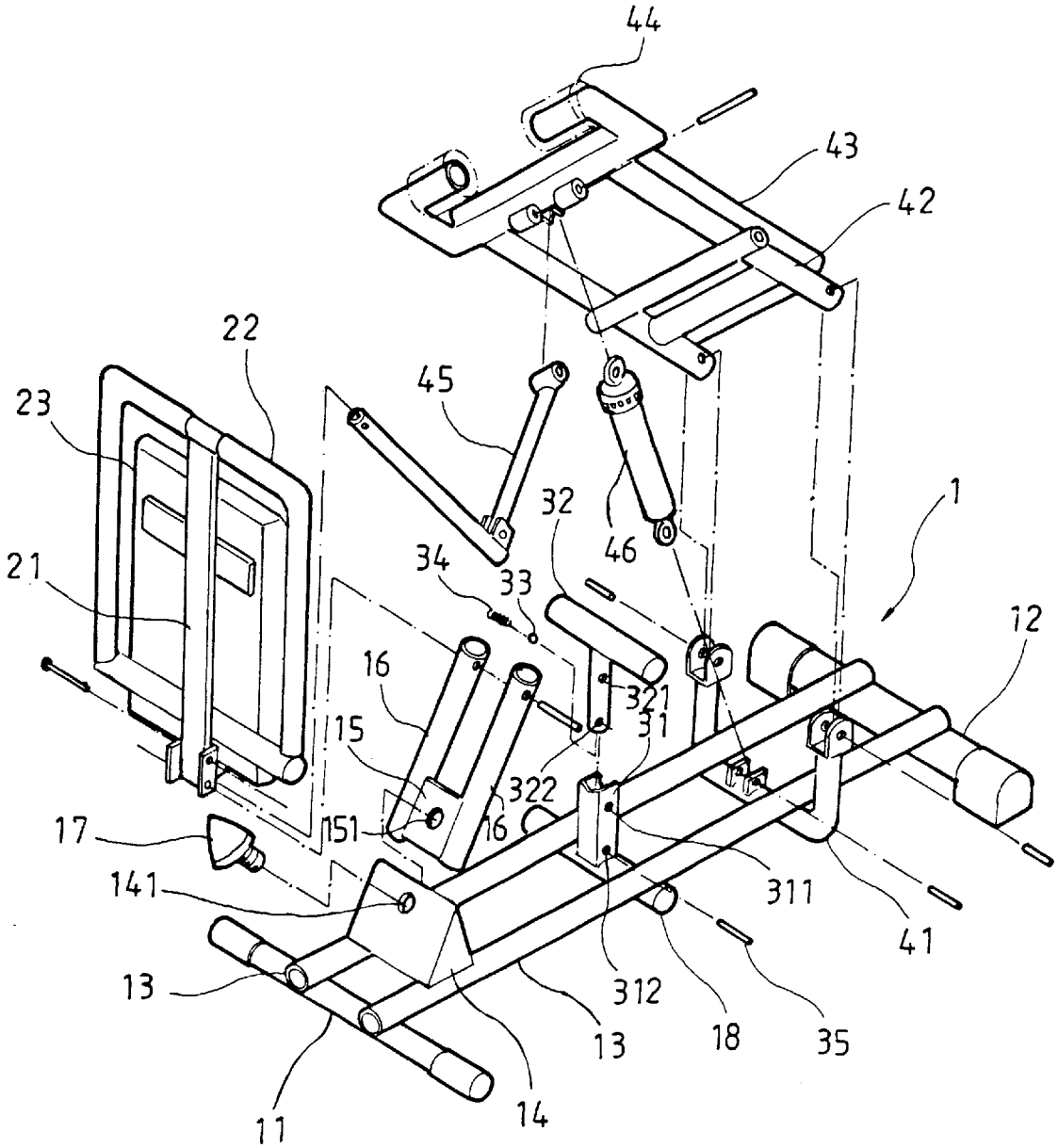
FIG. 2 is an exploded view of the present invention.

With reference to the drawings and in particular to FIGS. 1 and 2 thereof, the bridge flex machine according to the present invention generally comprises a base 1, a U-shaped member 16, an oscillating rod 21, a T-shaped rod 32, and a rectangular rack 42. The base 1 is composed of a front rod 11, a rear rod 12 and two transverse rods 13 mounted between the front and rear rods 11 and 12. The transverse rods 13 are provided close to the front rod 11 with a triangular block 14 which has a through hole 141 at the upper portion. The U-shaped member 16 is provided at the lower end with a sheet-like portion 15 having a threaded hole 151. The lower end of the U-shaped member 16 is slantingly inserted into the triangular block 14 and fixedly mounted thereon by a bolt 17 extending through the through hole 141 of the triangular block 141 and the threaded hole 151 of the U-shaped member 16.

The upper ends of the U-shaped member 16 is pivotally connected with the oscillating rod 21 on which is arranged a rectangular frame 22 for fastening a cushion 23 thereby enabling the rectangular frame 22 to move forwards and backwards with respect to the U-shaped member 16.

A rod 18 is mounted under the intermediate portions of the transverse rods 13 of the base 1. A vertical rod 31 with a U-shaped cross section is vertically installed on the intermediate portion of the rod 18 and formed with an upper through hole 311 and a lower through hole 312. A T-shaped rod 32 is vertically inserted into the vertical rod 31 and has an upper and lower holes 321 and 322 aligned with the upper and lower through holes 311 and 312 of the vertical rod 31. A pin 35 extends through the lower holes 312 and 322 to connect the T-shaped rod 32 with the vertical rod 31. A ball 33 is fitted inside the T-shaped rod 32 and forced by a spring 34 to protrudes partly out of the upper hole 321 so as to engage the T-shaped rod 32 with the vertical rod 31 at a vertical position and enable the T-shaped rod 32 to fold backwards.

A U-shaped rod 41 is mounted under the rear portions of the transverse rods 13 of the base 1. A rectangular rack 42 is pivotally mounted on the upper ends of the U-shaped rod 41. A cushion 43 is arranged on the rectangular rack 42 and two cylindrical pads 44 are installed on two opposite rod portions of one side of the rectangular rack 42. A foldable rod 45 is connected at an end with the bottom of the rectangular rack 42 and another end with the lower end of the oscillating rod 21. A hydraulic cylinder 46 is mounted between the bottom of the rectangular rack 42 and the intermediate portion of the U-shaped rod 41.

Accordingly, an user may bend from his or her waist and lie upwards to stretch his or her sinews and muscles by sitting on the cushion 43 and moving the rectangular frame 22 forwards and backwards.

Figure 3:
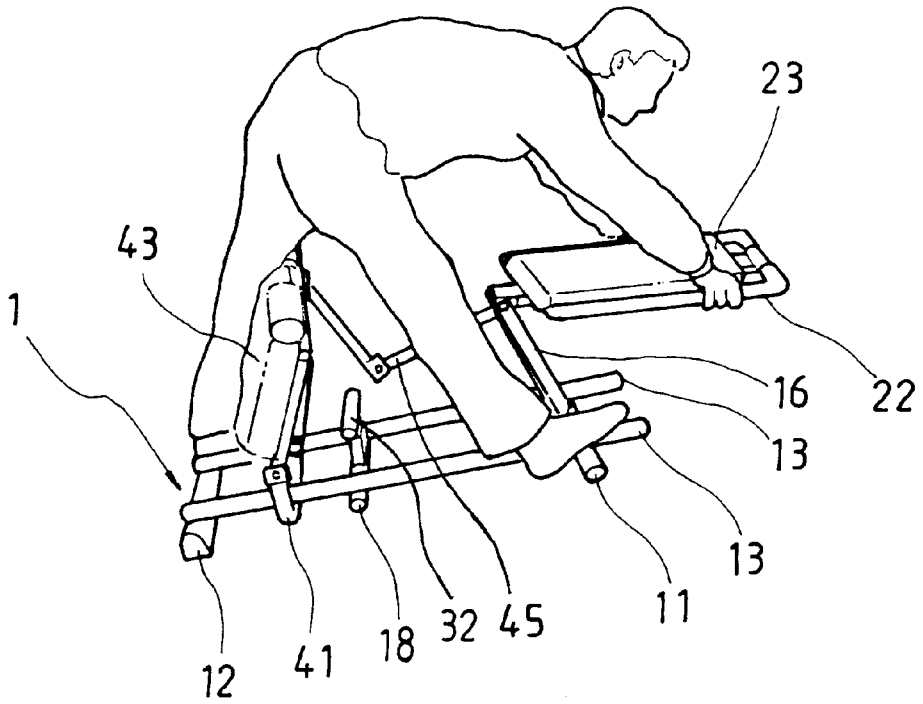
FIGS. 3, 4, 5, 6, 7 and 8 illustrate the working principle of the present invention.
Figure 4:
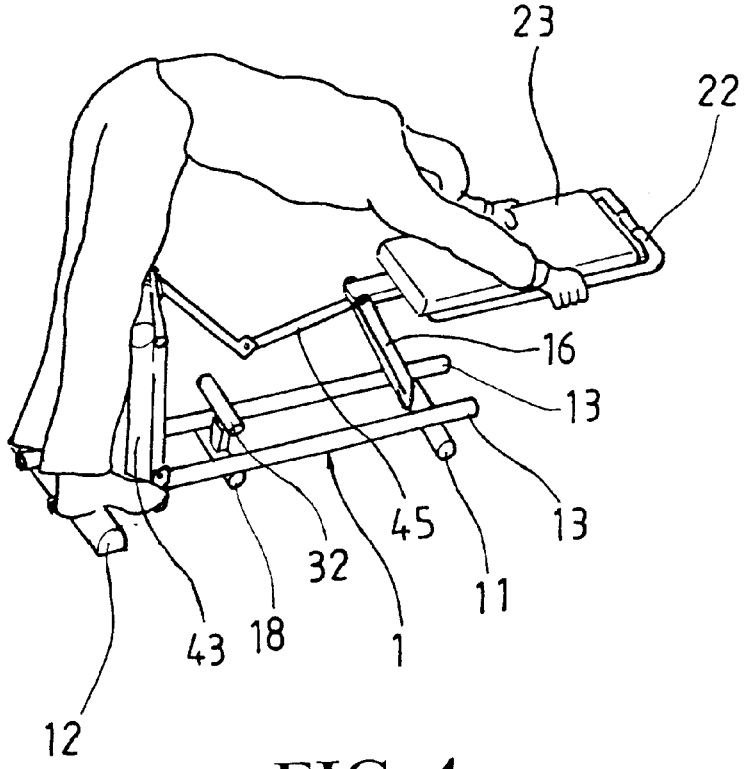
Figure 5:
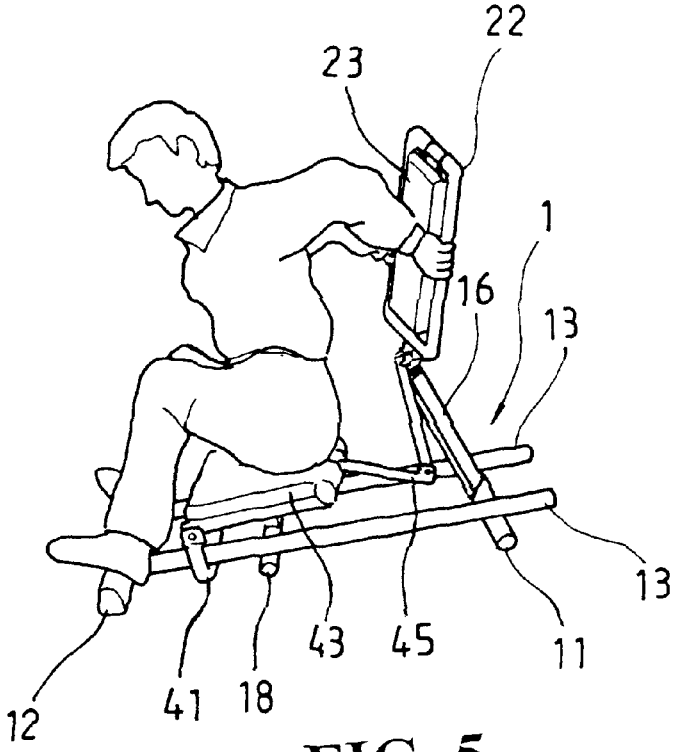
Figure 6:
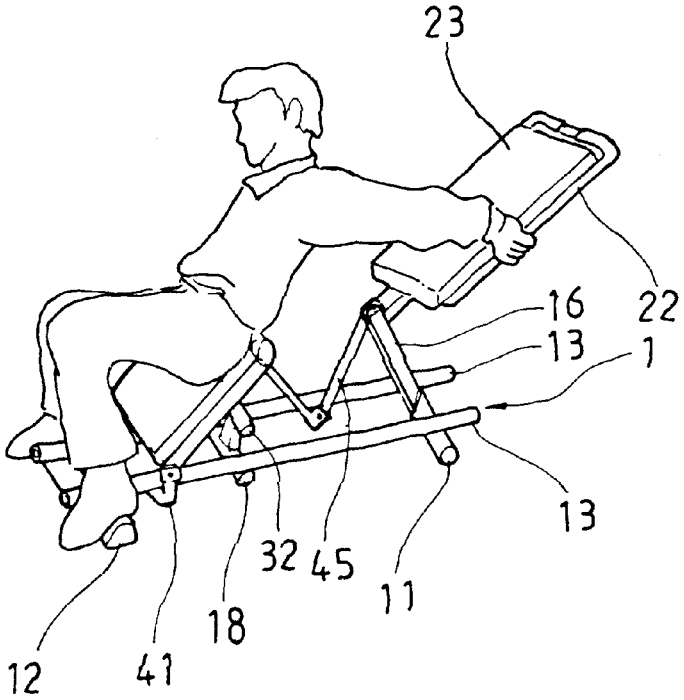
Figure 7:
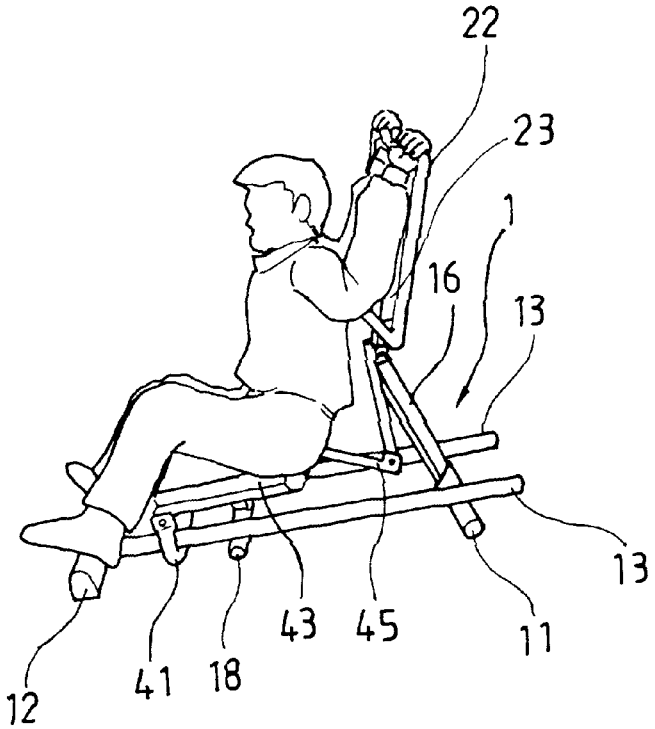
Figure 8:
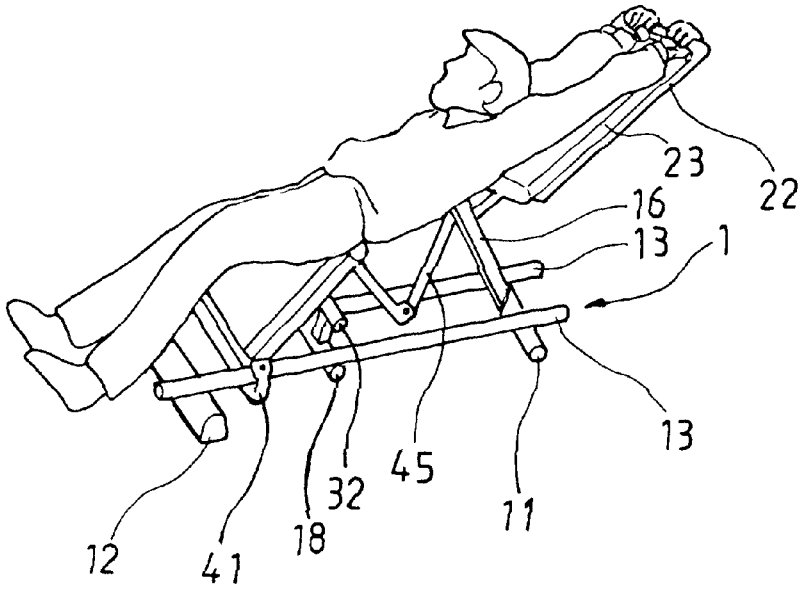

Referring to FIGS. 3 and 4, when in use, a user first holds two sides of the rectangular frame 22 with his or her two hands, bears against the cushion 43 with his or her two calves or put his or her two feet separately on the front and rear rods 11 and 12, and then pushes the rectangular frame 22 downwards by bending from his or her waist thereby exercising his or her waist muscles.

Referring to FIGS. 5, 6, 7 and 8, the user may sit on the cushion 43, hold the rectangular frame 22 with his or her two hands, put his or her feet on the rear rod 12, and then move the rectangular frame 22 downward so that the user lies upwards thereby stretching his sinews and muscles.

Figure 9:
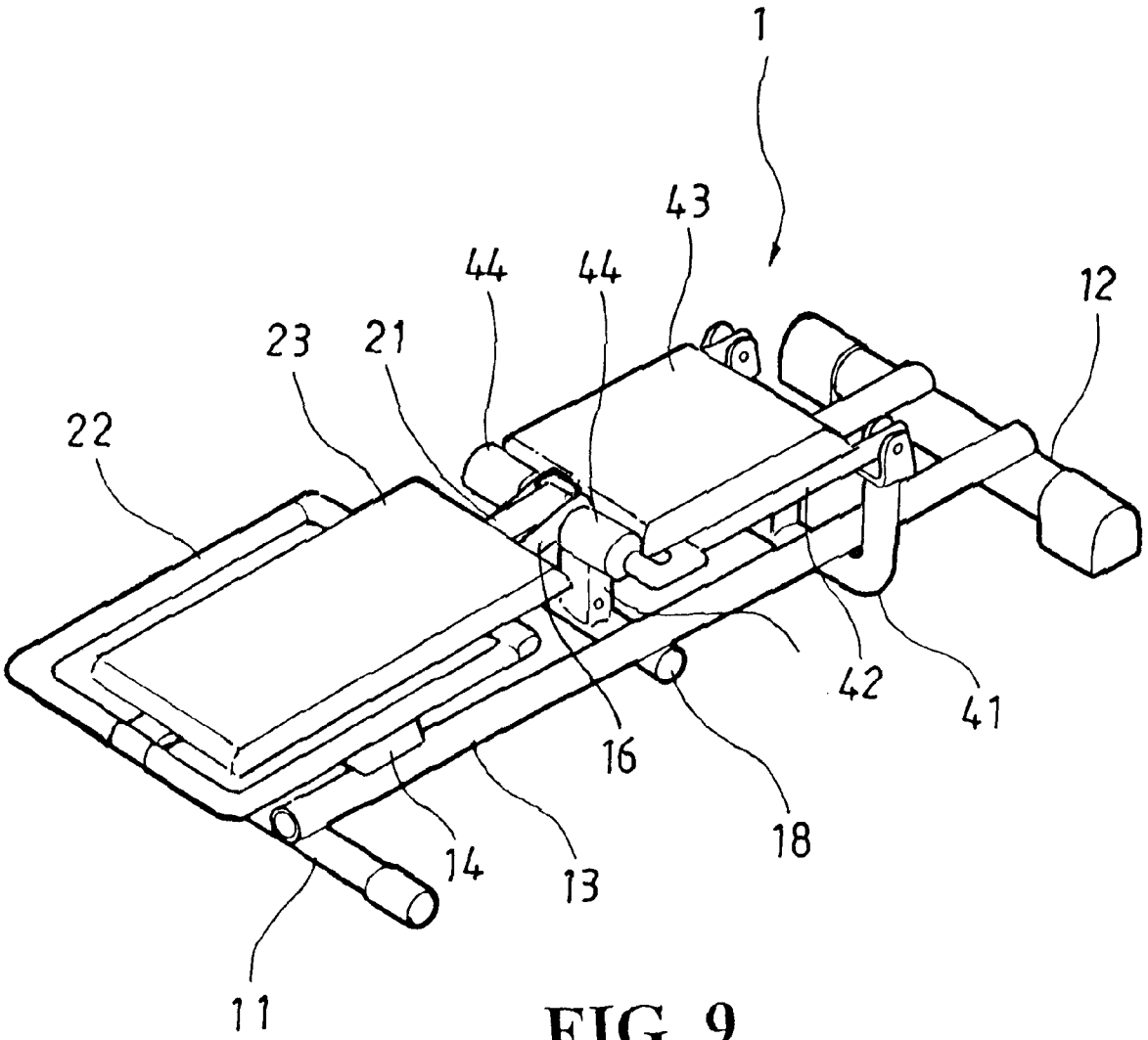
FIG. 9 illustrates how the present invention is folded when not in use.

When not in use, the T-shaped rod 32 is moved backwards and the rectangular frame 22 and the cushion 43 are collapsed inwardly to lie flat on the base 1 thereby enabling the bridge flex machine to be folded and therefore making it easier for stowage and transportation (see FIG. 9).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A bridge flex machine comprising:

a base composed of a first rod, a second rod and two transverse rods mounted between said first and second rods;

a triangular block mounted on said base and located to said first rod;

a U-shaped member slantingly inserted into said triangular member and fixedly mounted thereon by a bolt;

an oscillating rod pivotally connected with upper ends of said U-shaped member;

a rectangular frame arranged on said oscillating rod;

a vertical rod with a U-shaped cross section vertically mounted on an intermediate portion of said base;

a T-shaped rod vertically inserted in said vertical rod;

a U-shaped rod mounted on said base;

a rectangular rack pivotally mounted on two ends of said U-shaped rod; and a foldable rod having an end pivotally connected to a bottom of said rectangular rack and another end pivotally connected to an end of said oscillating rod.

2. The bridge flex machine as claimed in claim 1, wherein a spring loaded ball is fitted inside said T-shaped rod and tends to protrude partly out of said T-shaped rod to engage said T-shaped rod with said vertical rod.

3. The bridge flex machine as claimed in claim 1, wherein said rectangular rack has one side provided with two opposite rod portions each enclosed with a cylindrical pad.

* * * * *